United States Patent [19]

Weinert

[11] 4,138,637

[45] Feb. 6, 1979

[54] ATTENUATOR WITH COMPENSATION OF IMPEDANCE ERRORS

[75] Inventor: Fritz K. Weinert, Gaithersburg, Md.

[73] Assignee: Weinschel Engineering Co., Gaithersburg, Md.

[21] Appl. No.: 801,873

[22] Filed: May 31, 1977

[51] Int. Cl.[2] ..... H01P 1/22

[52] U.S. Cl. ..... 323/74; 333/81 R

[58] Field of Search ..... 323/74, 79, 81; 333/81 R, 81 A

[56] References Cited

U.S. PATENT DOCUMENTS

| | | | |
|---|---|---|---|
| 2,940,058 | 7/1960 | Foster | 333/81 R |
| 3,014,187 | 12/1961 | Sher et al. | 333/81 R |
| 3,351,863 | 11/1967 | Riemens | 333/81 R |
| 3,449,697 | 6/1969 | Mison | 333/81 R |
| 3,518,585 | 6/1970 | Wilcox | 323/74 |
| 3,529,266 | 9/1970 | King | 323/74 |
| 3,753,170 | 8/1973 | Holland | 333/81 A |

OTHER PUBLICATIONS

"A 1-18 GHz Attenuator Calibrator" by Weinert & Weinschel, *IEEE Trans. on Inst. & Measurement* vol. 1M-25, No. 4, Dec. 1976.

*Primary Examiner*—Gerald Goldberg

*Attorney, Agent, or Firm*—William D. Hall; Geoffrey R. Myers

[57] ABSTRACT

Step attenuators wherein a number of individual attenuators are connected in series, with a switch across each individual attenuator, are well known. By opening and closing particular combinations of the switches, any one of a number of different values of attenuation may be selected. Each individual attenuator has in the past, as well as in the present invention, had a characteristic impedance equal to the impedance of both the signal generator (which feeds the input of the step attenuator) and the load (connected across the output of the step attenuator). However, the switches for selecting the individual attenuators may have substantial resistance especially where solid state switching diodes or mercury wetted reed relays are employed. The latter type switches display resistances caused by skin effect at highter frequencies. This causes inaccuracies of the attenuation steps due to mismatch, in prior art systems of the type described above. To avoid the mismatch, an additional impedance is added to the circuit, between each adjacent pair of attenuators, to form a network. The network includes the resistance of the switches. This network is designed to have a characteristic impedance equal to the characteristic impedance of each attenuator. Stated otherwise, it has the same characteristic impedance as the impedance of the signal generator and the impedance of the load.

16 Claims, 10 Drawing Figures

FIG. 1
PRIOR ART
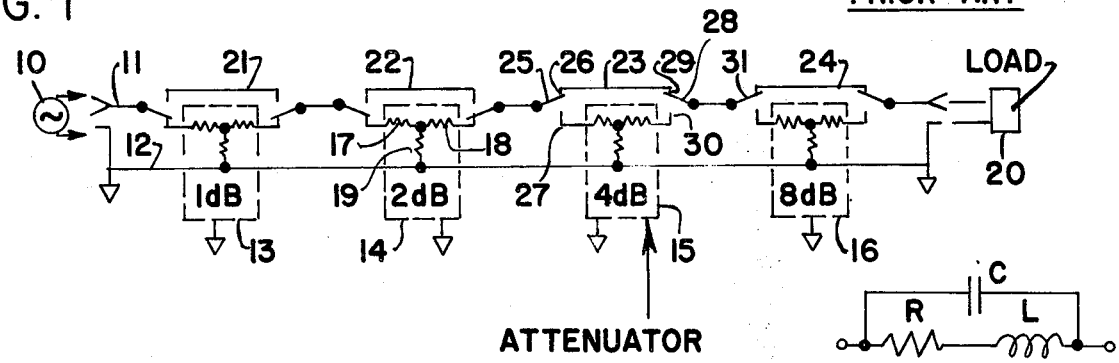
FIG. 2
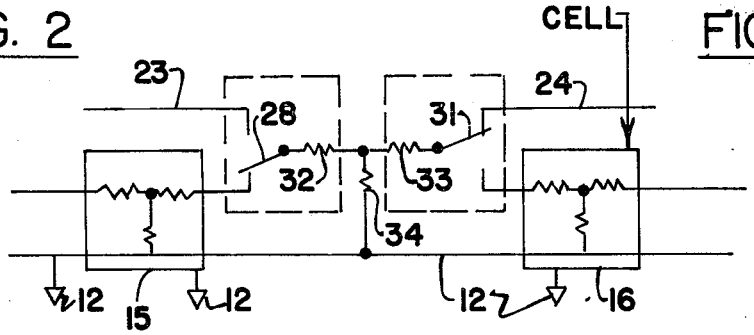
FIG. 6
| R Ω | L nH | C pF |
|---|---|---|
| 5 | 8 | .6 |
| 20 | 14 | .5 |
| 50 | 17 | .4 |
| 100 | 25 | .5 |
| 250 | 50 | .5 |
| 800 | - | .5 |
FIG. 3
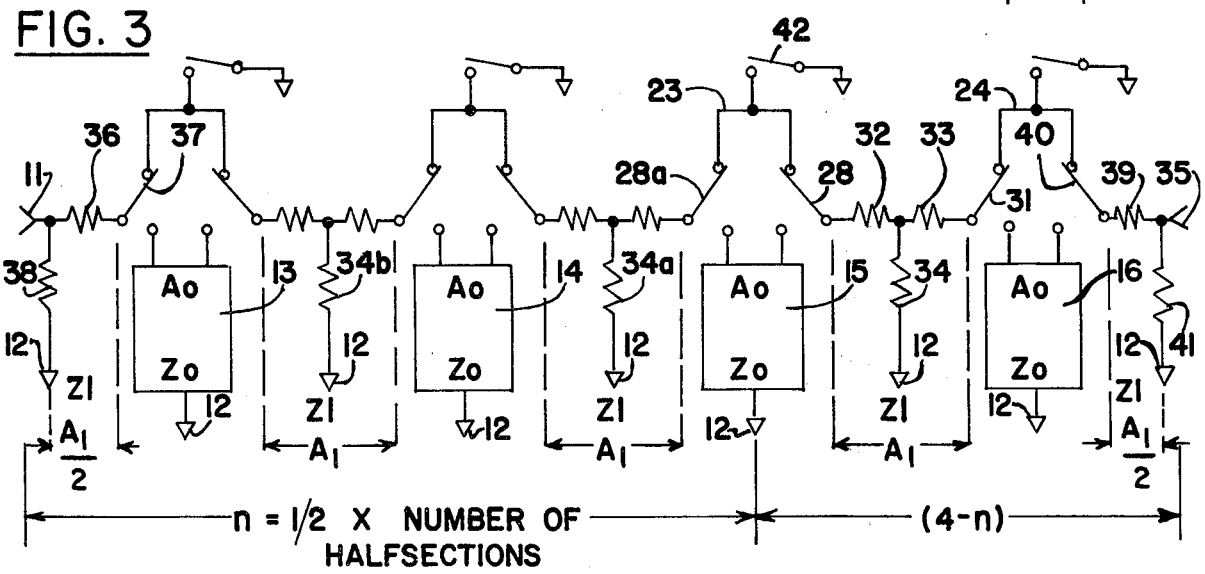
FIG. 9
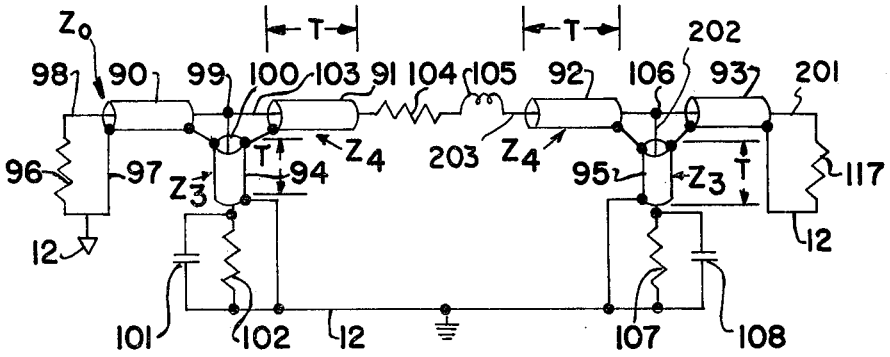

ATTENUATOR WITH COMPENSATION OF IMPEDANCE ERRORS

BACKGROUND OF THE INVENTION

There are situations where it is desirable to have step attenuators for providing selected values of attenuation to an electrical circuit. Two basic forms of step attenuators have been used at radio and microwave frequencies. In one form a number of different attenuator pads are located on a rotating member and the desired attenuation is obtained by rotating the member to select the desired pad. In another form of step attenuator, a number of individual attenuators, of different values, for example progressing in binary order, such as 1 dB, 2 dB, 4 dB, and 8 dB, are connected in series. There is an individual switch pair for inserting or removal of each individual attenuator. By opening and closing the switches, it is possible to select any given value of attenuation up to the sum of the attenuations of all of the attenuators. Irrespective of the form of switching employed for selection of the individual attenuators, there is resistance in the switches. As a result, there is an error in the attenuation step created. The error arises by reason of the fact that the source and load impedances seen by the individual attenuators are mismatched to their characteristic impedance, due to the switch impedances.

The primary object of this invention is to achieve a high accuracy by overcoming the errors of the attenuation steps created by the aforesaid mismatch.

Furthermore, in practical application of attenuator cells, consisting of individual resistors, errors of the attenuation steps are observed due to reactive components of the resistors themselves and of their leads by which they are connected together to form said attenuator cells. Another object of this invention is to correct the attenuator for errors resulting from these reactances.

SUMMARY OF THE INVENTION

In order to achieve a high accuracy of the individual attenuator steps, the mismatch described hereinabove is avoided by adding at least one shunt impedance between one side of the switch which is causing the mismatch and ground. These shunt impedances form with the resistance of the switch a network that has the same characteristic impedance as the characteristic impedance of each individual attenuator.

The reactances, referred to above, are compensated by proper choice of the distances of the resistor leads to the grounded housing of each attenuator, by the dielectric constant of the lead supports and their lengths, which determines their series inductances and shunt capacitances. These values are accurately implemented in the preferred embodiment by the resistor leads going through calibrated dielectric filled holes in one of the metallic walls of the attenuator housing.

BRIEF DESCRIPTION OF THE DRAWINGS

FIG. 1 is a schematic view of a prior art step attenuator that does not embody the invention.

FIG. 2 illustrates an improved switching arrangement for the step attenuator of FIG. 1, and which does embody the invention as regards resistive compensation.

FIG. 3 is a precision digital step attenuator embodying the invention.

FIG. 6 is a table and drawing showing the impedances of a particular film resistor such as may be used in the attenuator cells of this invention.

FIG. 9 shows one implementation of an attenuator cell as regards reactive compensation.

DETAILED DESCRIPTION OF THE DRAWINGS

Figure 4:
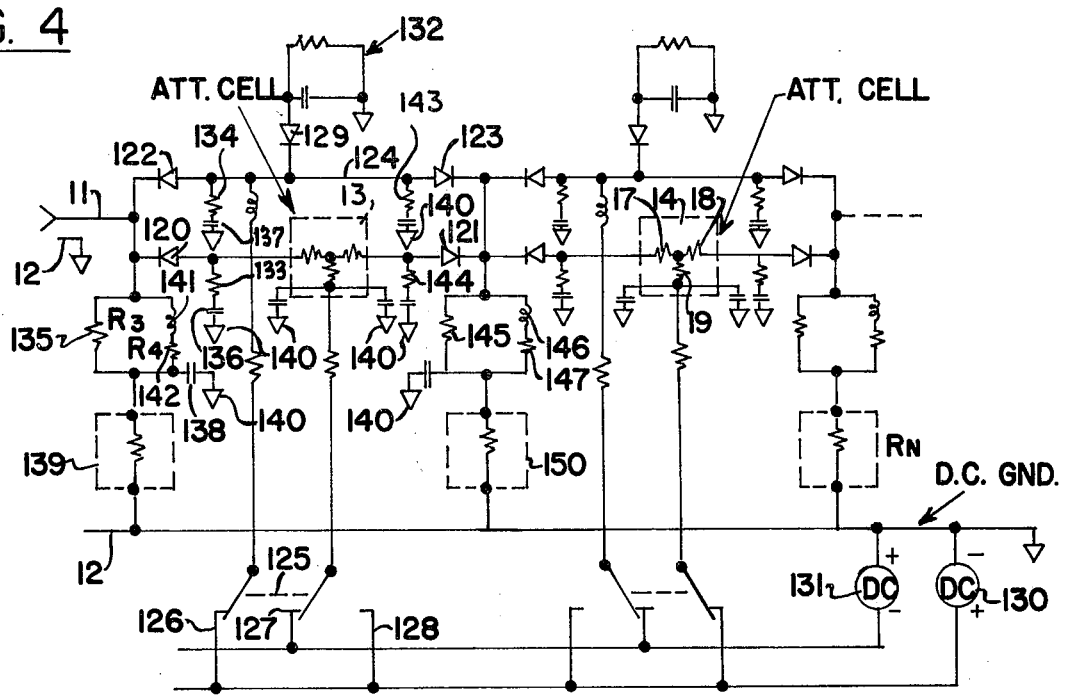
FIG. 4 is a modified form of the invention utilizing PIN diodes, as the switches, in the place of the mercury wetted reed relays of FIG. 2.

In FIG. 1 a prior art step attenuator is shown. FIG. 1 shows a signal generator 10 feeding the input poles 11 and 12 of the step attenuator. The overall step attenuator includes four attenuator cells 13, 14, 15, and 16, which respectively have attenuation values of 1 dB, 2 dB, 4 dB, and 8 dB. Each attenautor cell has a resistor network that provides the required attenuation as well as provides the correct characteristic impedance for the attenuator cell. Since the network is the same for all four cells 13, 14, 15, and 16, except for the amount of attenuation one of these cells will be described as illustrative. The cell 14 employs resistors 17, 18 and 19, which are selected to provide the desired attenuation of 2 dB and a characteristic impedance equal to the impedance of the signal generator 10. A load 20 having the same impedance as the signal generator 10, and the same impedance as the characteristic impedance of each of the attenuator cells 13 to 16 inclusive is normally employed. Bypass lines 21, 22, 23 and 24 are provided for the four attenuator cells 13, 14, 15 and 16 respectively. In connection with each attenuator cell, there are two single-pole double-throw switches. For example, in connection with line 23 there is a single-pole double-throw switch 25 which may be moved to engage either of two contacts; one, the contact 26 at the left end of by-pass 23, or two, contact 27 at the input of attenuator cell 15. Similarly at the output of attenuator cell 15 there is the single-pole double-throw switch 28 which may engage either contact 29 of the bypass line 23 or the output terminal 30 of the attenuator cell 15. When both of switches 25 and 28 are switched to their upper positions, as shown in FIG. 1, attenuator cell 15 is replaced by line 23 and, therefore, does not provide any attenuation. Assuming that all of the switches for the four attenuator cells 13 to 16 inclusive are in the positions shown, attenuator cells 13 and 14 would be active but attenuator cells 15 and 16 would be bypassed, and, therefore, the attenuation of the step attenuator would be 3 dB, that is, the sum of the attenuations of attenuator cells 13 and 14. It is apparent that with the arrangement shown in FIG. 1, any combination of the four values, 8, 4, 2 and 1, can be attained by selecting the proper switches. In one preferred form of step attenuators, the single-pole double-throw switches such as 25 and 28 may be miniature hermetically sealed mercury wetted reed relays. However, any other suitable switches may also be used.

The various switches such as 25 and 28, in whatever form they may be constructed for the step attenuator, have inherent resistance. For example, assuming that the aforesaid reed relays are employed, there may be a contact resistance at dc of about 20 m Ω; however, this "contact" resistance may be as high as 1 Ω at 30 MHz due to the skin effect of the magnetic material of the switch. When the step attenuator is part of an apparatus where accurate changes of the amount of attenuation are important, but the exact value of attenuation of the overall attenuator is of only secondary importance, the aforesaid contact resistance is not important. One such use of an attenuator, where the contact resistance in and of itself is not important, was described in conjunction with FIG. 1 of the paper "A 1-18 GHz ATTENUATOR CALIBRATOR", by Fritz K. Weinert and Bruno O. Weinschel, IEEE Transact., IM-25, No. 4, December 1976, pp. 298-306.

However, the aforesaid contact resistance does create a problem since it causes the source and load impedances seen by the attenuator cells to differ from the value of their own characteristic impedance, and, therefore, creates an error of the attenuation steps. The purpose of the present invention is to overcome this mismatch.

FIG. 2 shows a portion of the apparatus of FIG. 1, but with suitable means added for avoiding the aforesaid "mismatch". In FIG. 2, two of the four attenuator cells 15 and 16 are shown together with the single-pole double-throw switches 28 and 31. The aforesaid "contact" resistance of switch 28 is represented schematically at 32 and the corresponding resistance of single-pole double-throw switch 31 is shown schematically at 33. It is understood that resistors 32 and 33 are not separate elements of the circuit but are inherent resistances of the switches 28 and 31. To avoid the mismatch created by the resistances 32 and 33, resistor 34 is added. It is connected at its upper end to the two switches 28 and 31, and at its lower end to the ground lead 12.

The incremental attenuation of an attenuator step is the change in attenuation due to insertion of an attenuator cell into the transmission path. The value of the incremental attenuation is equal to the attenuation value of the precision attenuator cell only if the generator and load impedances seen by it are equal to its own characteristic impedance. This condition is met as long as the matching networks formed by the switch resistances 32 and 33 and by the added shunt resistor 34, respectively (FIG. 2) have the same characteristic impedances as the precision attenuator cells. If these characteristic impedances differ from each other then the generator and load impedances seen by the precision attenuator cells are not matched anymore and cause the insertion loss to differ from the actual (and very stable) attenuation value of the precision attenuator cells. This resulting error is termed "incremental mismatch error" and is $$\Delta A = 20 \log \cdot \left| \frac{1 - 10^{-0.1A_0}(1 - 10^{-0.1A_1})(1 - 10^{-0.1A_3})\Gamma_1\Gamma_3}{1 - (1 - 10^{-0.1A_1})(1 - 10^{-0.1A_3})\Gamma_1\Gamma_3} \right| [\text{dB}] \quad (1)$$

where $A_1$ and $A_3$ are attenuation of source and load matching network, respectively, and $\Gamma_1$ and $\Gamma_3$ are defined in equations (12) and (14) respectively, below.

The equation just cited may be derived as follows:

The incremental mismatch error of a precision attenuator cell with mismatched generator and load is $$A = 20 \log \left| \frac{1 - s_{21}s_{12}\Gamma_G\Gamma_L}{1 - \Gamma_G\Gamma_L} \right| (\text{dB}) \quad (2)$$

where $S_{21}$ and $S_{12}$ are the forward and reverse transmission scattering coefficients of the precision attenuator cell under consideration. These are $$S_{21} = S_{12} = 10^{-0.05A_0} \quad (3)$$

where $A_0$ is the attenuation value of a precision attenuator cell in decibel and $\Gamma_G$ and $\Gamma_L$ are the reflection coefficients of the in $Z_0$ terminated generator and load matching networks as seen by the precision attenuator cell. The generator reflection coefficient is given by $$\Gamma_G = \frac{Z_2 - Z_0}{Z_2 + Z_0} \quad (4)$$

where $Z_2$ is the generator impedance seen by the precision attenuator cell and $$Z_2 = Z_1 \frac{1 + \Gamma_2}{1 - \Gamma_2} \quad (5)$$

where $Z_1$ is the characteristic impedance of the switch matching network $$Z_1 = \sqrt{r_1(r_1 + 2R_b)} \quad (6)$$

where $r_1$ is the resistance of switch 32 (switch 33 has the same value of resistance) of FIG. 2; $R_b$ is the shunt resistance of resistor 34. $\Gamma_2$ is the reflection coefficient seen by the precision attenuator cell, but referenced to the characteristic impedance $Z_1$ of the switch matching network $$\Gamma_2 = \frac{Z_2 - Z_1}{Z_2 + Z_1} = \Gamma_a 10^{-0.1A_1} \quad (7)$$

where $\Gamma_a$ is the reflection coefficient of the perfect load $Z_O$ referenced to $Z_1$ $$\Gamma_a = \frac{Z_0 - Z_1}{Z_0 + Z_1} \quad (8)$$

and $A_1$ = attenuation of switch matching network $$A_1 = 20 \log \frac{1 + r_1/Z_1}{1 - r_1/Z_1} (\text{dB}). \quad (9)$$

Equation (18) becomes with (19), (21), and (22)

$$\Gamma_G = \Gamma_1 \frac{10^{0.1A_1} - 1}{10^{0.1A_1} - \Gamma_1^2} \quad (10)$$

which reduces for $|\Gamma_1| << 1$ to $$\Gamma_G = \Gamma_1(1 - 10^{-0.1A_1}) \quad (11)$$

where $$\Gamma_1 = -\Gamma_a = \frac{Z_1 - Z_0}{Z_1 + Z_0} \quad (12)$$

Similarly the load reflection coefficient seen by the precision attenuator cell is $$\Gamma_L = \Gamma_3(1 - 10^{-0.1A_3}) \quad (13)$$

where $$\Gamma_3 = \frac{Z_3 - Z_0}{Z_3 + Z_0} \quad (14)$$

and $A_3$ = attenuation of load matching network $$A_3 = 20 \log \frac{1 + r_1/Z_3}{1 - r_1/Z_3} \text{ (dB)} \quad (15)$$

and $Z_3$ is the characteristic impedance of load-matching network $$Z_3 = \sqrt{r_3(r_3 + 2R_b)} \quad (16)$$

and $r_3$ is the switch resistance of one switch of the load-matching network.

Equation (2) with (11) and (13) becomes $$\Delta A = 20 \log \left| \frac{1 - 10^{-0.1A_0}(1 - 10^{-0.1A_1})(1 - 10^{-0.1A_3})\Gamma_1\Gamma_3}{1 - (1 - 10^{-0.1A_1})(1 - 10^{-0.1A_3})\Gamma_1\Gamma_3} \right| \text{(dB)}. \quad (1)$$

Equation (1) above is the mismatch error for one section of the step attenuator. The mismatch error of the entire attenuator (all of the parts shown in FIG. 3) is equal to:

$$20 \text{ Log} \left| \frac{1 - 10^{-0.1A_0} \cdot \Gamma_1^2(1 - 10^{-0.1A_{1n}})(1 - 10^{-0.1A_1(4-n)})}{1 - \Gamma_1^2(1 - 10^{-0.1A_{in}})(1 - 10^{-0.1A_1(4-n)})} \right| \text{[dB] This equals zero for } Z_1 = Z_0$$

where: $\Gamma = \frac{Z_1 - Z_0}{Z_1 + Z_0}$ and: $A1$ = LOSS OF MATCHING ATTENUATOR [DB]

Reference is also made to FIG. 3 of the drawing for an explanation of n, $A_1$ and $Z_1$. $Z_1$ is the characteristic impedance of a matching network. The parts of FIG. 3 marked $A_1$ constitute a matching network.

$A_0$ is the attenuation of an attenuator cell (see FIG. 3). This varies from cell to cell as described in conjunction with FIG. 1.

$Z_0$ is the characteristic impedance of an attenuator cell (see FIG. 3) and is the same for all four cells 13, 14, 15 and 16 (see FIG. 3).

For a particular application of the invention, as described in the above-cited publication, the attenuation of the matching networks is $A_1 \approx A_3 \approx 0.348$ dB for $T_1 \approx T_3 \approx 0$. For resistance increase of the switch by 5 percent we would get $A_1 = A_3 = 0.356$ dB and $\Gamma_1 = \Gamma_3 = 0.012$ which yield with (1) an error of 0.0000080 dB for high attenuation cells and 0.0000016 dB for a 1-db attenuation cell which corresponds to a temperature change of 20° C. for a temperature coefficient of the sheet resistance of the conducting skin of about 2.5 $\times 10^{-3}$/° C., for iron leads therefore, practically eliminating the switch matching networks as error sources due to temperature changes.

The temperature coefficient of the precision discrete resistors of the attenuator cells is typically ±1.5 ppm/° C. giving worst case changes of 0.0011 dB for a 60 dB four section cell over a 10° C. temperature change. This compares with a precision stainless-steel waveguide-below-cutoff piston attenuator incremental attenuation error of about 0.008 dB for the same temperature and attenuation range.

In FIG. 3 a step attenuator has four attenuator cells 13, 14, 15 and 16 which may have any selected values of attenuation, such as for example the values shown in FIG. 1. As another example, the four values may be 10 dB, 20 dB, 40 dB and 60 dB.

As shown in connection with attenuator cell 15, there is a bypass, such as 23, for each cell. There is a single-pole double-throw switch at the input of each cell and another single-pole double-throw switch at the output of each cell. For example, as in the case of FIGS. 1 and 2, the switch 28 at the output of attenuator cell 15 selects either the attenuator cell 15 or the bypass 23. The switch 28a at the input of attenuator cell 15 must, of course, be operated to make the same selection as is made by switch 28. Similarly, the switch 31 at the input of attenuator cell 16 selects either bypass 24 or the attenuator cell 16. The switch 40 at the output of the attenuator cell 16 is, of course, also operated to make the same selection (cell 16 or bypass 24) as was made by switch 31. Whenever the attenuator cell, such as 15, is selected instead of its complementary bypass, the bypass is grounded, as by the closing of a switch 42, for example. The three switches associated with any given cell (one at its input, one at its output, and one to ground the bypass) are preferably ganged to operate together although this is unnecessary. Indeed, all of the switches of FIG. 3 may be operated in unison by a common control apparatus. This control apparatus is entirely conventional and is, therefore, not shown, but it may comprise a calibrated dial (or a set of push buttons) which when operated to select the desired attenuation will operate the desired switches in the desired manner through a system of electromagnetic, electro-mechanical operators or mechanical cams.

Referring again to FIG. 3, there is a switch 37 at the input end having inherent resistance 36 at a frequency such as 30 MHz. In order that this inherent resistance 36 will not give the input circuit a characteristic impedance different from that of the four attenuator cells 13, 14, 15 and 16, there has been added the resistor 38. The resistance value of resistor 38 is selected so that with the inherent resistance 36, a network is formed that has the desired characteristic impedance (equal to the characteristic impedance of the cells). Similarly, in connection with the two switches between each adjacent pair of cells a shunt resistor is added to form a network that has a characteristic impedance equal to that of the cells. For example, resistor 34 was added between switches 28 and 31, to form a network comprising the inherent resistances 32 and 33 (of the switches 28 and 31 respectively), to give the switches 28 and 31 a characteristic impedance equal to that of the attenuator cells. In like manner to the input, there is a compensating resistor 41 at the output. That resistor taken in conjunction with the inherent resistance 39 of switch 40 forms a network having a characteristic impedance equal to that of each of the attenuator cells 13, 14, 15 and 16.

As stated above each set of parts marked $A_1$ constitutes a matching network. Similarly each set of parts marked $A_1/2$ constitute a matching network. It can be readily seen that each set of parts marked Al is really two sets of parts marked $A_1/2$. Each of resistors 34, 34*a* and 34*b* have half the resistance of each of resistors 38 and 41. Thus, we may consider that the combination of resistors 36 and 38 comprises an L. Two such L-shaped networks ($A_1/2$) are equal to one T-shaped section ($A_1$) comprising resistors 32, 33 and 34. When combining the two L-shaped networks the two shunt resistors are combined into their equivalent single resistor which, of course, then has only half the resistance of each one of the two shunt resistors before they were combined.

FIG. 4 is a modified form of the invention using PIN diodes in place of the mercury wetted reed relays. The attenuator cells 13 and 14 are identical to cells 13 and 14 of FIGS. 1 to 3. When diodes 120 and 121 are conducting and diodes 122 and 123 are cut-off, the signal on input 11 flows through the attenuator cell 13 and the bypass 124 is cut off. On the other hand if diodes 122 and 123 are conducting and diodes 120 and 121 are cut-off, the signal on pole 11 passes through the bypass 124 instead of the attenuator cell.

A double-pole double-throw switch 125 is employed to select either the attenuator cell 13 or bypass 124. When switch 125 is thrown to the left, as shown, contact 126 is positive, current flows from DC source 130 to, and through, diodes 122 and 123 rendering them conducting. The positive potential on the cathode of diode 129 biases it to cut-off. Similarly, the negative potential at DC source 131 renders switch contact 127 negative. Since this contact is connected through attenuator cell 13 to the anodes of diodes 120 and 121, those two diodes are cut off. Therefore, the signal from input pole 11 flows through bypass 124 but not through attenuator cell 13. When switch 125 is thrown to the right, the potentials applied to the diodes 120, 121, 122, 123 and 129 are reversed rendering diodes 120, 121 and 129 conducting and diodes 122 and 123 cut-off. Therefore, the signal on input pole 11 passes through attenuator cell 13 but not through bypass 124. Moreover, bypass 124 is grounded via diode 129 and a suitable RC circuit 132. In one form of the invention the resistances of the circuits are selected to provide a current of about 20 to 50 ma. through each diode when it is conducting.

As was the case with the mercury-wetted reed relays, the PIN diodes 120 to 123 inclusive have inherent resistance which results in a mismatch as described above. To overcome the mismatch resulting from diodes 120 and 122, resistors 133, 134 and 135 are added to the circuit. These resistors 133, 134 and 135 are connected through condensers 136, 137 and 138 to ground. To compensate for capacitive reactance in the circuit, inductor 141 and resistor 142 are connected across resistor 135.

In one practical embodiment of FIG. 4 resistor 135 may have 1000 ohms and resistor 142 may have 10 ohms. The inductor 141 preferably has higher impedance than the impedance of resistor 135. Thus, as an example, inductor 141 may have an inductance of 50 $\mu$ Henries where the operating frequency is 30 MHz.

The circuit is improved, by a small amount, by the negative resistance circuit 139. The negative resistance of circuit 139 is equal to the resistance of resistor 142, which in the above example is 10 ohms. Negative resistance circuit 139 provides a zero dc ground potential at the junction of diodes 122 and 120 and, therefore, permits direct cascading of any number of attenuation cells.

Moreover, it is noted that the AC ground 140 is isolated from the DC ground.

To provide the desired characteristic impedance for the output switching elements of attenuator cell 13, resistors 143, 144 and 145, and inductor 146 with resistor 147, have been added. These parts 143 to 147 function in like manner to parts 134, 133, 135, 141 and 142 and hence need not be described in detail. Negative resistance circuit 150 works in the same way as negative resistance circuit 139.

It is noted that the electrical components associated with attenuator cell 14 (FIG. 4) are the same as those associated with attenuator cell 13 (FIG. 4). Since the two sets of components for cells 13 and 14, of FIG. 4, work in like manner, it is not necessary to describe in detail the construction and mode of operation of the components associated with attenuator cell 14.

Figure 5:
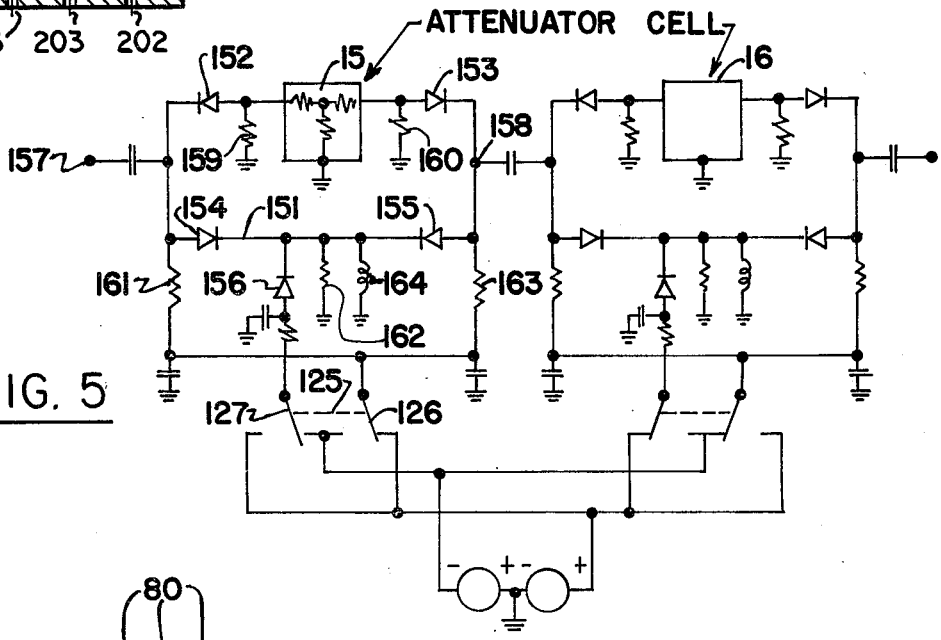
FIG. 5 is another modified form of the invention in which PIN diodes are employed to perform the switching action.

FIG. 5, like FIG. 2, illustrates two attenuator cells 15 and 16, of a step attenuator having two or more cells. There is a bypass 151 across cell 15. The PIN diodes 152, 153, 154 and 155 constitute switches for selecting either the attenuator cell 15 or the bypass 151. When the switch 125 is thrown to the right, as shown, the switch arm 126 will be positive and the switch arm 127 will be negative. This will pass current through diodes 154 and 155 rendering them conducting, and will bias diodes 152 and 153 to cut-off. Since switch arm 127 is negative the diode 156 will be cut-off. As a result any signal at input 157 will flow through the bypass 151 (to the input 158 of the second stage of the step attenuator), and no signal from input 157 will pass to the attenuator cell 15 since diode 154 will be cut off.

When switch 125 of FIG. 5 is moved to the left, the polarity of the potentials on the diodes 152, 153, 154, 155 and 156 will be reversed so that diodes 152, 153 and 156 will conduct, and diodes 154 and 155 will be biased to cut off. As a result (a) any signal on input 157 will pass through diodes 152 and 153 and attenuator cell 15 to the input 158 of the next stage of the step attenuator, and (b) bypass 151 will be grounded via diode 156.

As explained above, PIN diodes 152, 153, 154 and 155 have inherent resistance which results in the mismatch as described above. To correct for the mismatch, resistors 159, 160, 161, 162 and 163 have been added to the circuit in accordance with the aforesaid teachings relating to correcting for mismatches. Inductor 164 is added to compensate for the inherent capacity of the other parts of the circuit.

Since the circuit associated with attenuator cell 16 is identical with that for attenuator cell 15, and since that circuit has the same construction and mode of operation as the circuit associated with attenuator cell 15, a description of the circuit associated with attenuator cell 16 is deemed unnecessary.

Both T-section attenuators (FIG. 1) and pi-section attenuators, infra, are old, and either form may be used in this invention. However, either form may embody improvements as described below.

Figure 7:
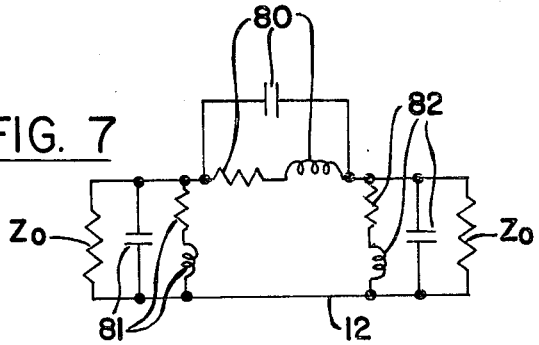
FIG. 7 is a schematic view of a pi-section of an attenuator cell showing the inherent reactances.

In the preferred embodiment, as described in the above-cited publication, the attenuator cells have been built as pi-sections using film resistors on glass with a temperature coefficient of ±1.5 ppm/° C. and aging less than 25 ppm/year. The impedance of the film resistors may, of course, be measured. The accuacy of the impedance measurement (≈ 2 percent of Γ) at 30 MHz is several orders of magnitude worse than the dc accuracy of the resistors (0.005 percent) precluding a direct measurement of deviation from dc value. Measurements were made from 10–800 MHz and the data were fitted to the model shown in FIG. 6 resulting in series inductances and parallel capacitances shown. It should be clearly understood that the values set forth in FIG. 6 represent those for a particular single film resistor such as any one of 17, 18 and 19. These values were used in the design of the attenuator cells. FIG. 7 shows the equivalent circuit of a pi-section. In this case the pi-section representing an attenuator cell is a different type from cells 13 to 16 of FIG. 1. It employs a single resistor 80 (Resistor 80 has inherent inductance and capacity, as explained in conjunction with FIG. 6. These inherent reactances are also designated by reference numeral 80.) and two shunt impedances 81 and 82. Since each of impedances 81 and 82 is primarily a resistor that has inherent inductance and capacity, I have shown the same to include the inductive and capacitive reactances as explained in conjunction with FIG. 6. The input and output terminating impedances Zo are also shown.

Figure 8:
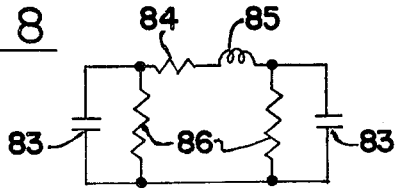
FIG. 8 is a schematic view in which the shunt impedances of FIG. 7 are combined with the terminations, and the reactances are reduced to equivalent series inductance or parallel capacitance. Moreover, shunt capacitors have been added.

In FIG. 8 the shunt impedances of FIG. 7 are combined with the terminations, and the reactances are reduced to equivalent series inductance or parallel capacitance at 30 MHz. Moreover, shunt capacitors 83 are added in order to make input and output impedances real. The condition for this is (for $\omega L_o << R_o + R_2$ and $1/\omega C_o << R_o$)

$$L_0/C_0 = 2R_0^2 + R_2^2 \div 2R_0R_2.$$

Therefore, according to FIG. 8 a pi-section attenuator cell is basically a resistor 84 having inherent inductance 85 and two shunt resistors 86 and two shunt capacitors 83.

The shunt capacitance 83, across the input of the attenuator cell (FIG. 8), is composed of the shunt capacitance of the resistor 102 presented by coaxial line 94 (FIG. 9) plus the line capacitance of the lead of resistor 102. Similarly the series inductance is composed of the equivalent resistor inductance 105 plus twice the lead line inductance where $R_0 = R_1 \cdot R_2/(R_1 + R_2)$. In the formula just stated $R_0$ is the resistance of each resistor 86 (FIG. 8). $R_1$ is the resistance of resistor 102 of FIG. 9, and $R_2$ is the resistance of resistor 104 of FIG. 9.

Figure 10:
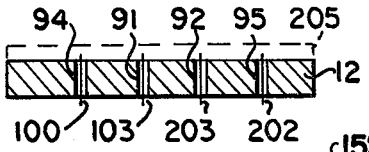
FIG. 10 illustrates the subject matter of FIG. 9 in another form.

FIGS. 9 and 10 show a practical implementation of FIG. 8. The circuit is mounted on a metal base 12 which acts as the ground conductor having four round holes therethrough, these holes being represented by the four tubes 91, 92, 94 and 95. Four conductors of the circuit pass through the four holes (shown as tubes) respectively but are insulated from the grounded metal base 12. Thus the input 96 has two conductors 90 and 98 which form a transmission line of a characteristic impedance equal to $Z_o$ shown in FIG. 9 as a coaxial line, where 90 is the grounded outer conductor and 98 is the center conductor being connected to the junction 99. Extending from junction 99 is conductor 100 that passes through hole 94 in the base and into resistor 102 which has inherent capacity 101. Another conductor 103 from junction 99 passes through hole 91 in the metal base and into resistor 104 which has inherent inductance 105. After leaving resistor 104 (with its inherent inductance 105) the resistor lead 203 passes through the metal base 12 via hole 92 to junction 106 where it is joined and by the resistor lead 202, passing through hole 95 of shunt resistor 107 (which has inherent capacity 108). Center conductor 201 of the transmission line of characteristic impedance equal to $Z_o$, extends from junction 106 to load 117; where 93 represents the grounded outer conductor of said transmission line.

FIG. 10 shows a metal base 12 for the attenuator. The base 12 has holes 94, 91, 92 and 95 through which conductors 100, 103, 203 and 202 pass. These conductors are connected in a circuit as shown in FIG. 9. The circuit of FIG. 9 may be mounted on base 12 and a small part of that circuit is shown, simply for purposes of illustration as 205 in FIG. 10.

Compensation is obtained by choice of $Z_3$ and $Z_4$ and is implemented by different hole sizes through the shielding wall of the attenuator of thickness T and by fitting the attenuator leads with sleeves of dielectric material which fill exactly the holes; where $Z_3$ is the impedance resulting from the conductor passing through hole 94 (which is equal to the impedance resulting from the conductor passing through hole 95), and $Z_4$ is the impedance resulting from the wire passing through hole 91 (which is equal to the impedance from the wire passing through hole 92).

The mercury wetted reed relays were selected because of their stable contact resistance, fast switching speed of 2ms, bounce free operation, long-life expectancy and high reliability.

Depending on the amount of attenuation desired, one skilled in the art may select either the Pi or the T type of attenuator. In FIG. 8 the resistance values of resistors 86 and 84 are chosen so that resistor 84 contains an equivalent series inductance 85 and resistors 86 contain equivalent shunt capacitances 83. It is understood that FIG. 8 comprises an alternate form of attenuator cell which may replace any one or more of cells 13 to 16.

Having given the necessary background information therefor, I will next describe one of the inventive contributions relating to the foregoing apparatus.

The inherent inductance 85 is compensated for by adding shunt capacitors 83 to provide a real impedance for the attenuator cell equal to the desired characteristic impedance of the cell as discussed in connection with FIGS. 1 to 3. The capacitance 83 at the input of the attenuatator cell of FIG. 8 is formed by conductor 100 passing through the hole 94 in the metal base. Preferably conductor 100 is held in a fixed position respecting the inner side walls of the hole 94 by insulating dielectric material although the spacing between the conductor 100 and the inner wall of the hole 94 may be maintained in any other suitable way. Similarly, the output capacitance 83 is formed by the conductor passing through hole 95 in the metal base. The holes 90 and 93 together with the conductors passing therethrough are matched lines and have no effect on the operation of the attenuator since they terminate in the desired characteristic impedance. In contrast, however, the resistor 104, together with its leads, has inherent inductance 85 (FIG. 8) which is compensated for by capacitance 83.

It is understood that the foregoing improvement which comprises shunt compensating capacitances 83 at the input and output of the pi-type attenuator (FIG. 8) is equally applicable to a T-type attenuator.

I claim to have invented:

1. An attenuator comprising an attenuator cell having an input and an output, said attenuator cell including means to give the cell a given characteristic impedance, a by-pass connected across said attenuator cell, and means including a switch for selection of said by-pass in place of said attenuator cell, said switch having inherent resistance, wherein the improvement comprises:

impedance means connected to said switch to form at least one network, which network includes the inherent resistance of said switch, having a characteristic impedance equal to said given characteristic impedance of said attenuator cell.

2. An attenuator as defined in claim 1, having at least two attenuator cells forming a step attenuator, each said cell having said given characteristic impedance, the output of one of said attenuator cells feeding the input of the other, an individual by-pass for each of said at least two attenuators, said switching means including means for selecting either by-pass in place of its complementary attenuator cell, and including two switches between each of said at least two attenuator cells, said two switches being electrically interconnected, said impedance means having one end connected to the interconnection between said switches to form a network, which network includes the inherent resistances of said switches, having a characteristic impedance equal to said given characteristic impedance.

3. An attenuator as defined in claim 1 in which said switch is a single pole-double throw switch having three terminals, impedance means connected to each of the three terminals of the said single pole-double throw switch in which said impedance means forms with the said switch resistances two networks alternately connected to the single pole terminal of said switch, and which two networks have the same input and output characteristic impedances and which are equal to the said characteristic impedance of the attenuator cell, and which two said networks have the same attenuation.

4. An attenuator as defined in claim 1 in which said switch is a mercury wetted reed relay, single pole double throw.

5. An attenuator as defined in claim 1 in which said switch comprises two diodes, one in series with said by-pass and one in series with said attenuator cell, and means for biasing either of said diodes to cut-off.

6. An attenuator as defined in claim 5 having an additional single pole double throw switch, said last-named switch having two inputs either of which may be selected by said single pole of said additional switch, and impedance means connected to said additional switch to form, with said additional switch, a network having a characteristic impedance equal to said given characteristic impedance of the attenuator cell.

7. An attenuator as defined in claim 1 for attenuating a signal, said by-pass having an input and an output, said switch being single pole double throw, and having said single pole connected to receive said signal, said switch having two outputs respectively connected to said input of said attenuator cell and to the input of said by-pass.

8. In an attenuator cell, having an input and an output, a current path, from said input to said output, having resistor means in series with said current path, said resistor means comprising a resistor having input and output leads, said resistor means having inherent inductance, a ground, and shunt impedance means between said current path and ground to compensate the cell for said inherent inductance and to provide the cell with the desired impedance, said shunt impedance means including (a) shunt resistor means between said current path and ground, (b) first capacitive reactance means shunted between said input to the cell and ground, and (c) second capacitive reactance means shunted between the output of the cell and ground.

9. In an attenuator cell as defined in claim 8, said ground comprising a metallic housing wall having at least one hole therethrough, said hole having a wall, at least one of said capacitive reactance means comprising a conductor passing through said hole, providing capacity between said conductor and the wall of said hole.

10. In an attenuator as defined in claim 8, said ground comprising a metallic housing wall having at least first and second holes therethrough, each hole being defined by a conducting wall, said first capacitive reactance means comprising a conductor passing through said first hole and said second reactance means comprising a conductor passing through said second hole.

11. In an attenuator cell as defined in claim 8, said shunt resistor means comprising two shunt resistors, one connected between the input of said first-named resistor and ground and the other being connected between the output of said first-named resistor and ground.

12. In an attenuator cell as defined in claim 11, said ground comprising a metallic housing wall having at least one hole therethrough, said hole having a conducting wall, at least one of said capacitive reactance means comprising a conductor passing through said hole, providing capacitance between said wire and the wall of said hole.

13. In an attenuator as defined in claim 11, said ground comprising a metallic housing wall having at least first and second holes therethrough, each hole being defined by a conducting wall, said first capacitive reactance means comprising a conductor passing through said first hole and said second reactance means comprising a conductor passing through said second hole.

14. In an attenuator as defined in claim 8, said first-named resistor having a mid-point, said shunt resistor means being connected between said mid-point and ground.

15. In an attenuator cell as defined in claim 14, said ground comprising a metallic housing wall having at least one hole therethrough, said hole having a conducting wall, at least one of said capacitive reactance means comprising a conductor passing through said hole, providing capacitance between said conductor and the wall of said hole.

16. In an attenuator as defined in claim 14, said ground comprising a metallic housing wall having at least first and second holes therethrough, each hole being defined by a conductive wall, said first capacitive reactance means comprising a conductor passing through said first hole and said second reactance means comprising a conductor passing through said second hole.

* * * * *